US005482642A

United States Patent [19]

Agar et al.

[11] Patent Number: 5,482,642

[45] Date of Patent: Jan. 9, 1996

[54] DETERGENT COMPOSITIONS HAVING IMPROVED PERCARBONATE BLEACH STABILITY

[75] Inventors: Joseph T. H. Agar, Callerton; David E. Holt, Stannington, both of England

[73] Assignee: The Procter & Gamble Company, Cincinnati, Ohio

[21] Appl. No.: 255,290

[22] Filed: Jun. 7, 1994

Related U.S. Application Data

[63] Continuation of Ser. No. 2,509, Jan. 4, 1993, abandoned, which is a continuation of Ser. No. 771,930, Oct. 7, 1991, abandoned.

[30] Foreign Application Priority Data

Oct. 6, 1991 [GB] United Kingdom ..... 9021761

[51] Int. Cl.[6] ..... C110 3/395; C110 7/38; C110 3/08

[52] U.S. Cl. ..... 252/90; 252/95; 252/99; 252/134; 252/174; 252/174.13; 252/186.25

[58] Field of Search ..... 252/95, 99, 135, 252/174.13, 174, 90, 86.25

[56] References Cited

U.S. PATENT DOCUMENTS

| | | | |
|---|---|---|---|
| 3,951,838 | 4/1976 | Fujiwara et al. . | |
| 3,963,634 | 6/1976 | Tachibana et al. | 252/96 |
| 4,064,062 | 12/1977 | Yurko | 252/99 |
| 4,526,698 | 7/1985 | Kuroda | 252/99 |
| 4,552,681 | 11/1985 | Koch et al. | 252/140 |
| 4,869,843 | 9/1989 | Saito | 252/135 |
| 5,009,804 | 4/1991 | Clayton | 252/99 |

FOREIGN PATENT DOCUMENTS

| | | |
|---|---|---|
| 0337219 | 10/1989 | European Pat. Off. . |
| 4031910 | 4/1992 | Germany . |
| 4106880 | 9/1992 | Germany . |
| 59-193999 | 11/1984 | Japan . |
| 1146995 | 6/1989 | Japan . |
| 2258899 | 10/1990 | Japan . |
| 2122044 | 1/1984 | United Kingdom . |

*Primary Examiner*—Christine Skane
*Assistant Examiner*—Kery A. Fries
*Attorney, Agent, or Firm*—George W. Allen; Donald E. Hasse

[57] ABSTRACT

Detergent compositions containing sodium percarbonate bleach are provided in which at least 60% of the originally added percarbonate remains after 28 days storage at 32° C. and 80° RH. The compositions contain at least one multi-ingredient component and have a density in excess of 650 g/liter, a content of Iron, Manganese and Copper less than 25 ppm, an Equilibrium Relative Humidity at 32° C. of less than 30% and preferably a sodium sulfate content of less than 2.5% by weight.

10 Claims, No Drawings

DETERGENT COMPOSITIONS HAVING IMPROVED PERCARBONATE BLEACH STABILITY

This is a continuation of application Ser. No. 08/002,509, filed on Jan. 4, 1993, which is in turn a continuation of application Ser. No. 07/771,930, filed on Oct. 7, 1991, and now abandoned.

This invention relates to laundry detergent compositions incorporating an inorganic perhydrate salt as a source of oxygen bleach, and more especially to solid laundry detergent compositions containing sodium percarbonate as the perhydrate salt.

The inorganic perhydrate bleach most widely used in laundry detergent compositions is sodium perborate in the form of either the monohydrate or tetrahydrate. However, concerns about the impact of boron salts on the environment have led to an increasing interest in other perhydrate salts, of which sodium percarbonate is the most readily available.

Detergent compositions containing sodium percarbonate are known in the art. Sodium percarbonate is an attractive perhydrate for use in detergent compositions because it dissolves readily in water, is weight efficient and, after giving up its available oxygen, provides a useful source of carbonate ions for detergency purposes.

However, the inclusion of percarbonate salts in detergent compositions has been restricted hitherto by the relative instability of the bleach both as is and in use. Sodium percarbonate loses its available oxygen at a significant rate in the presence of ions of heavy metals such as iron, copper and manganese and also in the presence of moisture, these effects being accelerated at temperatures in excess of about 30° C.

Moisture and heavy metal ions are unavoidable components of conventional granular detergent compositions. This has resulted in marginally acceptable percarbonate bleach stability under Northern European summer conditions, where the average maximum temperature over the hottest months is from 21° C. to 25° C., and unacceptable stability under temperatures higher than this. Such conditions are found in the Middle East and Southern Asia and also in Southern Europe where average maximum temperatures are in the 27° C. to 33° C. range for the hottest summer month.

There has therefore been much activity by workers in the field to increase percarbonate stability so as to make it a viable component of detergent formulations. This activity has tended to concentrate on the protection of the percarbonate by coating the crystalline product or by inclusion of stabilising agents during its manufacture, or both. Thus, while it has proved possible to incorporate percarbonate salts in conventional detergent compositions so as to have acceptable percarbonate stability over periods reflecting normal product shelf life, the percarbonate salts have proved complex and expensive to manufacture. This has restricted their broadscale utilisation, as evidenced by the relatively small number of commercially available products containing percarbonate.

Inorganic perhydrate bleaches are invariably incorporated into detergent compositions by dry addition of the crystalline bleach to the remainder of the particulate components towards the end of the detergent manufacturing process. In conventional detergent processing the bulk of these components are in the form of spray-dried granules and the requirements for making spray-dried granules of the required density, particle flow and solution characteristics are such that little or no scope for modifying the basic nature of these granules has been possible.

The Applicants have now discovered that the formulation and processing of certain so-called 'concentrated' products of higher ingredient activity can be arranged so that the constraints applying to spray-dried granular products can be significantly reduced, if not overcome completely. This, in turn, has permitted the formulation of particulate laundry detergent products containing sodium percarbonate with no, or only basic, coating/stability agents, in which the sodium percarbonate has an acceptable stability over a period of time corresponding to the normal shelf life of the products.

It is therefore an object of the present invention to provide a concentrated particulate laundry detergent composition incorporating an alkali metal percarbonate bleach, said bleach displaying acceptable storage stability, together with satisfactory particle flow and solubility characteristics over the expected normal shelf life of the composition in the trade.

It is a further object of the present invention to provide a concentrated particulate laundry detergent composition incorporating an alkali metal percarbonate bleach displaying acceptable storage stability, in which the percarbonate bleach does not require complex protection techniques.

According to the present invention there is provided a solid laundry detergent composition, comprising by weight:

a) from about 5% to about 20% of an organic surfactant;

b) from about 25% to about 60% of one or more non phosphate detergent builder salts;

c) from about 3% to about 20% of an alkali metal percarbonate bleach;

d) from 0% to about 67% of detergent ingredients other than those in a) to c)

wherein the composition i) has a bulk density of at least about 650 g/liter, and comprises at least one multi-ingredient component;

ii) contains less than about 25 ppm total of Iron, Copper and Manganese ions; and iii) has an Equilibrium Relative Humidity of not more than about 30% as measured by a solid state hygrometer on the vapour over the composition in a closed container at 32° C., whereby the weight percentage of the original percarbonate remaining undecomposed after 28 days storage in closed wax laminated cardboard cartons at 32° C. and 80% Relative Humidity is at least about 60%.

Preferably the Equilibrium Relative Humidity is no more than about 25% by weight.

For the purposes of the present invention, Equilibrium Relative Humidity is measured as follows: 300 g of product is placed in a 1 liter container made of a water impermeable material and fitted with a lid capable of sealing the container. The lid is provided with a sealable hole adapted to allow insertion of a probe into the container interior. The container and contents are maintained at a temperature of 32° C. for 24 hours to allow temperature equilibration. A solid state Hygrometer (Hygrotest 6100, marketed by Testoterm Ltd., Old Flour Mill, Queen Street, Emsworth, Hampshire, England) is used to measure the water vapour pressure in the space over the product. Whilst the container is maintained at 32° C., the probe is inserted through the hole in the lid and measurements of the water vapour pressure are made at ten minute intervals until the vapour pressure has equilibrated, as evidenced by no change in two successive readings. The instrument converts the water vapour pressure measurement into a direct read-out of the Equilibrium Relative Humidity.

In a preferred embodiment of the invention, one multi-ingredient-component comprises an agglomerate of non-spray-dried ingredients together with a second multi-ingredient component comprising a spray-dried powder, the latter being in an amount of not more than 40% preferably not more than 35% by weight of the composition.

The compositions of the invention comprise, in general terms, those ingredients conventionally found in laundry detergent products.

A wide range of surfactants can be used in the detergent compositions. A typical listing of anionic, nonionic, ampholytic and zwitterionic classes, and species of these surfactants, is given in U.S. Pat. No. 3,929,678 issued to Laughlin and Heuring on Dec. 30, 1975. A list of suitable cationic surfactants is given in U.S. Pat. No. 4,259,217 issued to Murphy on Mar. 31, 1981.

Mixtures of anionic surfactants are suitable herein, particularly blends of sulfate, sulfonate and/or carboxylate surfactants. Mixtures of sulfonate and sulfate surfactants are normally employed in a sulfonate to sulfate weight ratio of from 5:1 to 1:2, preferably from 3:1 to 2:3, more preferably from 3:1 to 1:1.

Preferred sulfonates include alkyl benzene sulfonates having from about 9 to about 15, especially about 11 to about 13 carbon atoms in the alkyl radical, and alpha-sulfonated methyl fatty acid esters in which the fatty acid is derived from a $C_{12}$–$C_{18}$ fatty source, preferably from a $C_{16}$–$C_{18}$ fatty source. In each instance the cation is an alkali metal, preferably sodium. Preferred sulfate surfactants in such sulfonate sulfate mixtures are alkyl sulfates having from about 12 to about 22, preferably from about 16 to about 18 carbon atoms in the alkyl radical. Another useful surfactant system comprises a mixture of two alkyl sulfate materials whose respective mean chain lengths differ from each other. One such system comprises a mixture of $C_{14}$–$C_{15}$ alkyl sulfate and $C_{16}$–$C_{18}$ alkyl sulfate in a weight ratio of $C_{14}$–$C_{15}$: $C_{16}$–$C_{18}$ of from 3:1 to 1:1. The alkyl sulfates may also be combined with alkyl ethoxy sulfates having from 10 to 20, preferably 10 to 16 carbon atoms in the alkyl radical and an average degree of ethoxylation of 1 to 6. The cation in each instance is again an alkali metal, preferably sodium.

Other anionic surfactants suitable for the purposes of the invention are the alkali metal sarcosinates of formula $$R—CON\ (R)\ CH_2COOM$$

wherein R is a $C_9$–$C_{17}$ linear or branched alkyl or alkenyl C group, R' is a $C_1$–$C_4$ alkyl group and M is an alkali metal ion. Preferred examples are the lauroyl, Cocoyl ($C_{12}$–$C_{14}$), myristyl and oleyl methyl sarcosinates in the form of their sodium salts.

One class of nonionic surfactants useful in the present invention comprises condensates of ethylene oxide with a hydrophobic moiety, providing surfactants having an average hydrophilic-lipophilic balance (HLB) in the range from about 8 to about 17, preferably from about 9.5 to about 13.5, more preferably from 10 to 12.5 in which the hydrophobic (lipophilic) moiety may be aliphatic or aromatic in nature.

Especially preferred nonionic surfactants of this type are the $C_9$–$C_{15}$ primary alcohol ethoxylates containing moles of ethylene oxide per mole of alcohol, particularly the $C_{14}$–$C_{15}$ primary alcohols containing 6–8 moles of ethylene oxide per mole of alcohol and the $C_{12}$–$C_{14}$ primary alcohols containing 3–5 moles of ethylene oxide per mole of alcohol.

A further preferred class of nonionic surfactants comprises polyhydroxy fatty acid amides of general formula

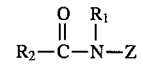

where $R_1$ is H, a $C_1$–$C_4$ hydrocarbyl, 2 hydroxyethyl, 2-hydroxypropyl or mixtures thereof, $R_2$ is a $C_5$–$C_{31}$ hydrocarbyl and Z is a polyhydroxyhydrocarbyl having a linear hydrocarbyl chain with at least three hydroxy groups directly connected to the chain, or an alkoxylated derivative thereof. In preferred members of this class the polyhydroxy hydrocarbyl moiety is derived from glucose or maltose or mixtures thereof and the $R_2$ group is a $C_{11}$–$C_{19}$ alkyl or alkenyl. Highly preferred compounds utilise a $C_{15}$–$C_{19}$ alkyl or alkenyl moiety as the $R_1$ group. Compositions incorporating such highly preferred polyhydroxy fatty acid amides are disclosed in the copending British Application No. 9113139 filed Jun. 18 1991.

Another class of nonionic surfactants comprises alkyl polyglucoside compounds of general formula $$RO(C_nH_{2n}O)_tZ_x$$

wherein Z is a moiety derived from glucose; R is a saturated hydrophobic alkyl group that contains from about 12 to about 18 carbon atoms; t is from 0 to 10 and n is 2 or 3; x is from 1.3 to 4, the compounds including less than about 10% unreacted fatty alcohol and less than about 50% short chain alkyl polyglucosides. Compounds of this type and their use in detergent compositions are disclosed in EP-B-0070074, 0070077, 0075996 and 0094118.

A further class of surfactants are the semi-polar surfactants such as amine oxides. Suitable amine oxides are selected from mono $C_8$–$C_{20}$, preferably $C_{10}$–$C_{14}$ N-alkyl or alkenyl amine oxides and propylene-1,3-diamine dioxides wherein the remaining N positions are substituted by methyl, hydroxyethyl or hydroxypropyl groups.

Cationic surfactants can also be used in the detergent compositions herein and suitable quaternary ammonium surfactants are selected from mono $C_8$–$C_{16}$, preferably $C_{10}$–$C_{14}$ N-alkyl or alkenyl ammonium surfactants wherein remaining N positions are substituted by methyl, hydroxyethyl or hydroxypropyl groups.

The detergent compositions comprise from about 5% to about 20% of surfactant but more usually comprise from about 7% to about 20%, more preferably from about 10% to about 15% by weight.

Combinations of surfactant types are preferred, more especially anionic-nonionic and also anionic-nonionic-cationic blends. Particularly preferred combinations are described in GB-A-2040987, GB 9113139 and EP-A-0087914. Although the surfactants can be incorporated into the compositions as mixtures, it is preferable to control the point of addition of each surfactant in order to optimise the physical characteristics of the composition and avoid processing problems. Preferred modes and orders of surfactant addition are described hereinafter.

The second essential component of compositions in accordance with the invention is a detergent builder system comprising one or more non-phosphate detergent builders. These can include, but are not restricted to alkali metal carbonates, bicarbonates, silicates, aluminosilicates, monomeric and oligomeric polycarboxylates, homo or copolymeric polycarboxylic acids or their salts in which the polycarboxylic acid comprises at least two carboxylic radicals separated from each other by not more than two carbon atoms, organic phosphonates and aminoalkylene poly (alkylene phosphonates) and mixtures of any of the foregoing.

The builder system is present in an amount of from about 25% to about 60% by weight of the system, more preferably from about 30% to about 60% by weight.

Preferred builder systems are free of boron compounds and any polymeric organic materials are biodegradable.

Suitable silicates are those having an $SiO_2$:$NaO_2$ ratio in the range from 1.6 to 3.4, the so-called amorphous silicates of $SiO_2$:$NaO_2$ ratios from 2.0 to 2.8 being preferred. These materials can be added at various points of the manufacturing process, such as in a slurry of components that are spray dried or in the form of an aqueous solution serving as agglomerating agent for other solid components, or, where the silicates are themselves in particulate form, as solids to the other particulate components of the composition. However, for compositions in which the percentage of spray dried components is low ie ≦30%, it is preferred to include the amorphous silicate in the spray-dried components.

Within the silicate class, highly preferred materials are crystalline layered sodium silicates of general formula $$NaMSi_xO_{2x+1}.yH_2O$$

wherein M is sodium or hydrogen, x is a number from 1.9 to 4 and y is a number from 0 to 20. Crystalline layered sodium silicates of this type are disclosed in EP-A-0164514 and methods for their preparation are disclosed in DE-A-3417649 and DE-A-3742043. For the purposes of the present invention, x in the general formula above has a value of 2, 3 or 4 and is preferably 2. More preferably M is sodium and y is 0 and preferred examples of this formula comprise the α, β, γ and δ forms of $Na_2Si_2O_5$. These materials are available from Hoechst AG FRG as respectively NaSKS-5, NaSKS-7, NaSKS-11 and NaSKS-6. The most preferred material is δ-$Na_2Si_2O_5$, NaSKS-6. Crystalline layered silicates are incorporated either as dry mixed solids, or as solid components of agglomerates with other components.

Whilst a range of aluminosilicate ion exchange materials can be used, preferred sodium aluminosilicate zeolites have the unit cell formula $$Na_z\,[(AlO_2)_z(SiO_2)_y]xH_2O$$

wherein z and y are at least 6; the molar ratio of z to y is from 1.0 to 0.5 and x is at least 5, preferably from 7.5 to 276, more preferably from 10 to 264. The aluminosilicate materials are in hydrated form and are preferably crystalline, containing from 10% to 28%, more preferably from 18% to 22% water in bound form.

The above aluminosilicate ion exchange materials are further characterised by a particle size diameter of from about 0.1 to about 10 micrometers, preferably from about 0.2 to about 4 micrometers. The term "particle size diameter" herein represents the average particle size diameter of a given ion exchange material as determined by conventional analytical techniques such as, for example, microscopic determination utilizing a scanning electron microscope or by means of a laser granulometer. The aluminosilicate ion exchange materials are further characterised by their calcium ion exchange capacity, which is at least about 200 mg equivalent of $CaCO_3$ water hardness/g of aluminosilicate, calculated on a anhydrous basis, and which generally is in the range of from about 300 mg eq./g to about 352 mg eq./g. The aluminosilicate ion exchange materials herein are still further characterised by their calcium ion exchange rate which is at least about 130 mg equivalent of $CaCO_3$/liter/minute/(g/liter) [2 grains Ca++/gallon/minute (gram/gallon)] of aluminosilicate (anhydrous basis), and which generally lies within the range of from about 130 mg equivalent of $CaCO_3$/liter/minute/(gram/liter) [2 grains/gallon/minute/(gram/gallon)] to about 390 mg equivalent of $CaCO_3$/liter/minute/(gram/liter) [6 grains/gallon/minute/(gram/gallon)], based on calcium ion hardness. Optimum aluminosilicates for builder purposes exhibit a calcium ion exchange rate of at least about 260 mg equivalent of $CaCO_3$/liter/minute/(gram/liter) [4 grains/gallon/minute/(gram/gallon)].

Aluminosilicate ion exchange materials useful in the practice of this invention are commercially available and can be naturally occurring materials, but are preferably synthetically derived. A method for producing aluminosilicate ion exchange materials is discussed in U.S. Pat. No. 3,985,669. Preferred synthetic crystalline aluminosilicate ion exchange materials useful herein are available under the designations Zeolite A, Zeolite B, Zeolite X, Zeolite HS and mixtures thereof. In an especially preferred embodiment, the crystalline aluminosilicate ion exchange material is Zeolite A and has the formula $$Na_{12}[(AlO_2)_{12}(SiO_2)_{12}].\ xH_2O$$

wherein x is from 20 to 30, especially 27. Zeolite X of formula $Na_{86}[(AlO_2)_{86}(SiO_2)_{106}]$. 276 $H_2O$ is also suitable, as well as Zeolite HS of formula $Na_6[(AlO_2)_6(SiO_2)_6]7.5\ H_2O$).

Suitable water-soluble monomeric or oligomeric carboxylate builders can be selected from a wide range of compounds but such compounds preferably have a first carboxyl logarithmic acidity/constant ($pK_1$) of less than 9, preferably of between 2 and 8.5, more preferably of between 4 and 7.5.

The logarithmic acidity constant is defined by reference to the equilibrium $$H^+ + A\ H^+A$$

where A is the fully ionized carboxylate anion of the builder salt.

The equilibrium constant is therefore $$K_1 = \frac{(H^+A)}{(H^+)\,(A)}$$

and $pK_1 = \log_{10}K$.

For the purposes of this specification, acidity constants are defined at 25° C. and at zero ionic strength. Literature values are taken where possible (see Stability Constants of Metal-Ion Complexes, Special Publication No. 25, The Chemical Society, London): where doubt arises they are determined by potentiometric titration using a glass electrode.

Preferred carboxylates can also be defined in terms of their calcium ion stability constant ($pK_{Ca++}$) defined, analogously to $pK_1$, by the equations $$pK_{Ca++} = \log_{10}K_{Ca++}$$

where $$K_{ca++} = \frac{(Ca{++}A)}{(Ca{++})\,(A)}$$

Preferably, the polycarboxylate has a $pK_{Ca++}$ in the range from about 2 to about 7 especially from about 3 to about 6. Once again literature values of stability constants are taken where possible. The stability constant is defined at 25° C. and at zero ionic strength using a glass electrode method of measurement as described in Complexation in Analytical Chemistry by Anders Ringbom (1963).

The carboxylate or polycarboxylate builder can be momomeric or oligomeric in type although monomeric polycarboxylates are generally preferred for reasons of cost and performance.

Monomeric and oligomeric builders can be selected from acyclic, alicyclic, heterocyclic and aromatic carboxylates having the general formulae

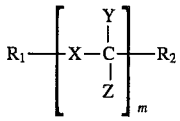

(a)

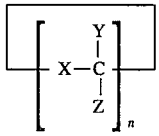

(b)

or

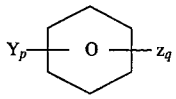

(c)

wherein $R_1$ represents H,$C_{1-30}$ alkyl or alkenyl optionally substituted by hydroxy, carboxy, sulfo or phosphono groups or attached to a polyethylenoxy moiety containing up to 20 ethyleneoxy groups; $R_2$ represents H,$C_{1-4}$ alkyl, alkenyl or hydroxy alkyl, or alkaryl, sulfo, or phosphono groups;

X represents a single bond; O; S; SO; $SO_2$; or $NR_1$;

Y represents H; carboxy;hydroxy; carboxymethyloxy; or $C_{1-30}$ alkyl or alkenyl optionally substituted by hydroxy or carboxy groups;

Z represents H; or carboxy;

m is an integer from 1 to 10;

n is an integer from 3 to 6;

p, q are integers from 0 to 6, p+q being from 1 to 6;

and wherein, X, Y, and Z each have the same or different representations when repeated in a given molecular formula, and wherein at least one Y or Z in a molecule contain a carboxyl group.

Suitable carboxylates containing one carboxy group include lactic acid, glycollic acid and ether derivatives thereof as disclosed in Belgian Patent Nos. 831,368, 821, 369 and 821,370. Polycarboxylates containing two carboxy groups include the water-soluble salts of succinic acid, malonic acid, (ethylenedioxy) diacetic acid, maleic acid, diglycollic acid, tartaric acid, tartronic acid and fumaric acid, as well as the ether carboxylates described in German Offenlegenschrift 2,446,686, and 2,446,687 and U.S. Pat. No. 3,935,257 and the sulfinyl carboxylates described in Belgian Patent No. 840,623. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,082,179, while polycarboxylates containing phosphone substituents are disclosed in British Patent No. 1,439,000.

Alicyclic and heterocyclic polycarboxylates include cyclopentane-cis,cis,cis-tetracarboxylates, cyclopentadienide pentacarboxylates, 2,3,4,5-tetrahydrofuran-cis, cis, cis-tetracarboxylates, 2,5-tetrahydrofuran-cis-dicarboxylates, 2,2,5,5-tetrahydrofuran-tetracarboxylates, 1,2,3,4,5,6-hexane-hexacarboxylates and carboxymethyl derivatives of polyhydric alcohols such as sorbitol, mannitol and xylitol. Aromatic polycarboxylates include mellitic acid, pyromellitic acid and the phthalic acid derivatives disclosed in British Patent No. 1,425,343.

Of the above, the preferred polycarboxylates are hydroxycarboxylates containing up to three carboxy groups per molecule, more particularly citrates.

The parent acids of the monomeric or oligomeric polycarboxylate chelating agents or mixtures thereof with their salts, eg. citric acid or citrate/citric acid mixtures are also contemplated as components of builder systems useful in the present invention.

Other suitable water soluble organic salts are the homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of MWt 2000–5000 and their copolymers with maleic anhydride, such copolymers having a molecular weight of from about 20,000 to about 70,000, especially about 40,000. These materials are normally used at levels of from about 0.5% to about 10% by weight more preferably from about 0.75% to about 8%, most preferably from about 1% to about 6% by weight of the composition. Organic phosphonates and amino alkylene poly (alkylene phosphonates) include alkali metal ethane 1-hydroxy diphosphonates, nitrilo trimethylene phosphonates, ethylene diamine tetra methylene phosphonates and diethylene triamine penta methylene phosphonates, although these materials are less preferred where the minimisation of phosphorus compounds in the compositions is desired.

For the purposes of compositions in accordance with the invention, the non-phosphate builder ingredient will comprise from about 25% to about 60% by weight of the compositions, more preferably from about 30% to about 60% by weight. Within the preferred compositions, a sodium aluminosilicate such as Zeolite A will comprise from about 20% to about 60% by weight of the total amount of builder, a monomeric or oligomeric carboxylate will comprise from about 10% to about 30% by weight of the total amount of builder and a crystalline layered silicate will comprise from about 10% to about 65% by weight of the total amount of builder. In such compositions the builder ingredient preferably also incorporates a combination of auxiliary inorganic and organic builders such as sodium carbonate and maleic anhydride/acrylic acid copolymers in amounts of up to about 35% by weight of the total builder.

The compositions of the present invention can be prepared in a variety of ways so as to display an Equilibrium Relative Humidity of not more than the critical value of about 30%. Thus for a number of non-phosphate detergent builders, preferred compositions will maximise the amount of non phosphate detergent builder ingredient added as a dry mix component, thereby reducing the level of the spray dried component. For certain other non phosphate detergent builders such as the alkali metal aluminosilicate zeolites, conditions employed in the preparation of the spray dried component lead to overdrying of the aluminosilicate, resulting in a spray dried powder displaying desiccant characteristics. This in turn permits a higher level of such a spray dried powder in a composition without exceeding the 30% Equilibrium Relative Humidity limit. As described hereinbefore, preferred compositions contain no more than about 40% and more preferably no more than about 35% by weight of a spray dried powder component.

The third essential component of the compositions of the invention is a solid percarbonate bleach, normally in the form of the sodium salt, incorporated at a level of from about 3% to about 20% by weight, more preferably from about 5% to about 18% by weight and most preferably from about 8% to about 15% by weight of the composition.

Sodium percarbonate is an addition compound having a formula corresponding to $2Na_2CO_3 . 3H_2O_2$, and is available commercially as a crystalline solid. Most commercially available material includes a low level of a heavy metal sequestrant such as EDTA, 1-hydroxyethylidene 1,1-diphosphonic acid (HEDP) or an amino-phosphonate, that is incorporated during the manufacturing process. For the purposes of the present invention, the percarbonate can be incorporated into detergent compositions without additional protection, but preferred embodiments of the invention utilise a coated form of the material. Although a variety of coatings can be used, the most economical is sodium silicate of $SiO_2$: $Na_2O$ ratio from 1.6:1 to 2.8:1, preferably 2.0:1, applied as an aqueous solution to give a level of from about 2% to about 10%, (normally from about 3% to about 5%) of silicate solids by weight of the percarbonate. Magnesium silicate can also be used and a chelant such as one of those mentioned above can also be included in the coating.

The particle size range of the crystalline percarbonate is from about 350 micrometers to about 450 micrometers with a mean of approximately 400 micrometers. When coated, the crystals have a size in the range from about 400 to about 600 micrometers.

Whilst heavy metals present in the sodium carbonate used to manufacture the percarbonate can be controlled by the inclusion of sequestrants in the reaction mixture, the percarbonate still requires protection from heavy metals present as impurities in other ingredients of the product. It has been found that the total level of Iron, Copper and Manganese ions in the product should not exceed about 25 ppm and preferably should be less than about 20 ppm in order to avoid an unacceptably adverse effect on percarbonate stability.

Compositions in accordance with the invention can also contain up to about 67% of non-surfactant non detergent builder components as optional ingredients. Anti-redeposition and soil-suspension agents, optical brighteners, soil release agents, dyes and pigments are examples of such optional ingredients and can be added in varying amounts as desired.

Anti-redeposition and soil-suspension agents suitable herein include cellulose derivatives such as methylcellulose, carboxymethylcellulose and hydroxyethylcellulose, and homo- or co-polymeric polycarboxylic acids or their salts. Polymers of this type include copolymers of maleic anhydride with ethylene, methylvinyl ether or methacrylic acid, the maleic anhydride constituting at least 20 mole percent of the copolymer. These materials are normally used at levels of from about 0.5% to about 10% by weight, more preferably from about 0.75% to about 8%, most preferably from about 1% to about 6% by weight of the composition.

Other useful polymeric materials are the polyethylene glycols, particularly those of molecular weight 1000–10000, more particularly from about 2000 to about 8000 and most preferably about 4000. These are used at levels of from about 0.20% to about 5% more preferably from about 0.25% to about 2.5% by weight. These polymers and the previously mentioned homo- or co-polymeric polycarboxylate salts are valuable for improving whiteness maintenance, fabric ash deposition, and cleaning performance on clay, proteinaceous and oxidizable soils in the presence of transition metal impurities.

Preferred optical brighteners are anionic in character, examples of which are disodium $4,4^1$-bis-(2-diethanolamino-4-anilino-s-triazin-6-ylamino) stilbene-$2:2^1$ disulfonate, disodium 4, $4^1$-bis-(2-morpholino-4-anilino-s-triazin-6-ylamino)stilbene- $2:2^1$-disulfonate, disodium $4,4^1$-bis-( 2,4-dianilino-s-triazin-6-ylamino)stilbene-$2:2^1$-disulfonate, monosodium $4^1$, $4^{11}$-bis-(2,4-dianilino-s-triazin- 6 ylamino)stilbene-2-sulfonate, disodium $4,4^1$-bis-( 2-anilino-4-(N-methyl-N-2-hydroxyethylamino)-s-triazin-6-ylamino)stilbene-$2,2^1$-disulfonate, disodium $4,4^1$-bis-( 4-phenyl-2,1,3-triazol-2-yl)-stilbene-$2,2^1$ disulfonate, disodium $4,4^1$bis(2-anilino-4-(1-methyl- 2-hydroxyethylamino)-s-triazin-6-ylamino)stilbene-$2,2^1$disulfonate and sodium 2(stilbyl-$4^{11}$-(naphtho-$1^1$, $2^1$:4,5)-1,2,3-triazole-$2^{11}$-sulfonate.

Soil-release agents useful in compositions of the present invention are conventionally copolymers or terpolymers of terephthalic acid with ethylene glycol and/or propylene glycol units in various arrangements. Examples of such polymers are disclosed in the commonly assigned U.S. Pat. Nos. 4,116,885 and 4,711,730 and European Published Patent Application No. 0272033. A particular preferred polymer in accordance with EP-A-0272033 has the formula $$(CH_3(PEG)_{43})_{0.75}(POH)_{0.25}[T—PO)_{2.8}\ (T—PEG)_{0.4}]T(PO—H)_{0.25}((PEG)_{43}CH_3)_{0.75}$$

where PEG is—$(OC_2H_4)0$—, PO is $(OC_3H_6O)$ and T is $(pCOC_6H_4CO)$.

Certain polymeric materials such as polyvinyl pyrrolidones typically of Mwt 5000–20000, preferably 10000–15000, also form useful agents in preventing the transfer of labile dyestuffs between fabrics during the washing process.

Another preferred ingredient is a peroxy carboxylic acid bleach precursor, commonly referred to as a bleach activator, which is preferably added in a prilled or agglomerated form. Examples of suitable compounds of this type are disclosed in British Patent Nos, 1586769 and 2143231 and a method for their formation into a prilled form is described in European Published Patent Application No. 0062523. Preferred examples of such compounds are tetracetyl ethylene diamine and sodium 3, 5, 5 trimethyl hexanoyloxybenzene sulphonate.

Bleach activators are normally employed at levels of from 0.5% to 10% by weight, more frequently from 1% to 8% and preferably from 2% to 6% by weight of the composition.

Another optional ingredient is a suds suppressor, exemplified by silicones, and silica-silicone mixtures. Silicones can be generally represented by alkylated polysiloxane materials while silica is normally used in finely divided forms, exemplified by silica aerogels and xerogels and hydrophobic silicas of various types. These materials can be incorporated as particulates in which the suds suppressor is advantageously releasably incorporated in a water-soluble or water-dispersible, substantially non-surface-active detergent-impermeable carrier. Alternatively the suds suppressor can be dissolved or dispersed in a liquid carrier and applied by spraying on to one or more of the other components.

As mentioned above, useful silicone suds controlling agents can comprise a mixture of an alkylated siloxane, of the type referred to hereinbefore, and solid silica. Such mixtures are prepared by affixing the silicone to the surface of the solid silica. A preferred silicone suds controlling agent is represented by a hydrophobic silanated (most preferably trimethyl-silanated) silica having a particle size in the range from 10 nanometers to 20 nanometers and a specific surface area above 50 $m^2/g$, intimately admixed with dimethyl silicone fluid having a molecular weight in the range from about 500 to about 200,000 at a weight ratio of silicone to silanated silica of from about 1:1 to about 1:2.

A preferred silicone suds controlling agent is disclosed in Bartollota et al. U.S. Pat. No. 3,933,672. Other particularly useful suds suppressors are the self-emulsifying silicone suds suppressors, described in German Patent Application DTOS 2,646,126 published Apr. 28, 1977. An example of such a compound is DC-544, commercially availably from Dow Corning, which is a siloxane/glycol copolymer.

The suds suppressors described above are normally employed at levels of from about 0.001% to about 0.5% by weight of the composition, preferably from about 0.01% to about 0.1% by weight.

The preferred methods of incorporation comprise either application of the suds suppressors in liquid form by spray-on to one or more of the major components of the composition or alternatively the formation of the suds suppressors into separate particulates that can then be mixed with the other solid components of the composition. The incorporation of the suds modifiers as separate particulates also permits the inclusion therein of other suds controlling materials such as $C_{20}$–$C_{24}$ fatty acids, microcrystalline waxes and high MWt copolymers of ethylene oxide and propylene oxide which would otherwise adversely affect the dispersibility of the matrix. Techniques for forming such suds modifying particulates are disclosed in the previously mentioned Bartolotta et al U.S. Pat. No. 3,933,672.

Another optional ingredient useful in the present invention is one or more enzymes.

Preferred enzymatic materials include the commercially available amylases, neutral and alkaline proteases, lipases, esterases and cellulases conventionally incorporated into detergent compositions. Suitable enzymes are discussed in U.S. Pat. Nos. 3,519,570 and 3,533,139.

Fabric softening agents can also be incorporated into detergent compositions in accordance with the present invention. These agents may be inorganic or organic in type. Inorganic softening agents are exemplified by the smectite clays disclosed in GB-A-1,400,898. Organic fabric softening agents include the water insoluble tertiary amines as disclosed in GB-A-1514276 and EP-B-0011340.

Their combination with mono $C_{12}$–$C_{14}$ quaternary ammonium salts is disclosed in EP-B-0026527 & 528. Other useful organic fabric softening agents are the dilong chain amides as disclosed in EP-B-0242919. Additional organic ingredients of fabric softening systems include high molecular weight polyethylene oxide materials as disclosed in EP-A-0299575 and 0313146.

Levels of smectite clay are normally in the range from about 5% to about 15%, more preferably from about 8% to about 12% by weight, with the material being added as a dry mixed component to the remainder of the formulation. Organic fabric softening agents such as the water-insoluble tertiary amines or dilong chain amide materials are incorporated at levels of from about 0.5% to about 5% by weight, normally from about 1% to about 3% by weight, whilst the high molecular weight polyethylene oxide materials and the water soluble cationic materials are added at levels of from about 0.1% to about 2%, normally from about 0.15% to about 1.5% by weight. Where a portion of the composition is spray dried, these materials can be added to the aqueous slurry fed to the spray drying tower, although in some instances it may be more convenient to add them as a dry mixed particulate, or spray them as a molten liquid on to other solid components of the composition.

A feature of the compositions of the present invention is that they are of relatively high density in comparison with conventional laundry detergent compositions. Such high density compositions have become known as concentrated products and are characterised by a bulk density of at least about 650 g/liter, more usually at least about 700 g/liter and more preferably in excess of about 800 g/liter. Bulk density is measured by means of a simple funnel and cup device consisting of a conical funnel moulded rigidly on a base and provided with a flap valve at its lower extremity to allow the contents of the funnel to be emptied into an axially aligned cylindrical cup disposed below the funnel. The funnel is 130 mm high and has internal diameters of 130 mm and 40 mm at its respective upper and lower extremities. It is mounted so that the lower extremity is 140 mm above the upper surface of the base. The cup has an overall height of 90 mm, an internal height of 87 mm and an internal diameter of 84 mm. Its nominal volume is 500 ml.

To carry out a measurement, the funnel is filled with powder by hand pouring, the flap valve is opened and powder allowed to overfill the cup. The filled cup is removed from the frame and excess powder removed from the cup by passing a straight edged implement eg. a knife, across its upper edge. The filled cup is then weighed and the value obtained for the weight of powder doubled to provide the bulk density in g/liter. Replicate measurements are made as required.

Another feature of compositions of the present invention is that they incorporate at least one multi-ingredient component ie. they do not comprise compositions formed merely by dry-mixing individual ingredients. Compositions in which each individual ingredient is dry-mixed are generally dusty, slow to dissolve and also tend to cake and develop poor particle flow characteristics in storage.

Subject to the above bulk density and component content limitations, the compositions of the invention can be made via a variety of methods including dry mixing, spray drying, agglomeration and granulation and preferred methods involve combinations of these techniques. A preferred method of making the compositions involves a combination of spray drying, agglomeration in a high speed mixer and dry mixing.

Preferred detergent compositions in accordance with the invention comprise at least two particulate multi-ingredient components. The first component comprises at least about 15%, conventionally from about 25% to about 50%, but more preferably no more than about 35% by weight of the composition and the second component from about 1% to about 50%, more preferably from about 10% to about 40% by weight of the composition.

The first component comprises a particulate incorporating an anionic surfactant in an amount of from about 0.75% to about 40% by weight of the powder and one or more inorganic and/or organic salts in an amount of from about 99.25% to about 60% by weight of the powder. The particulate can have any suitable form such as granules, flakes, prills, marumes or noodles but is preferably granular. The granules themselves may be agglomerates formed by pan or drum agglomeration or by in-line mixers but are customarily spray dried particles produced by atomising an aqueous slurry of the ingredients in a hot air stream which removes most of the water. The spray dried granules are then subjected to densification steps, eg. by high speed cutter mixers and/or compacting mills, to increase density before being reagglomerated. For illustrative purposes, the first component is described hereinafter as a spray dried powder.

Suitable anionic surfactants for the purposes of the first component have been found to be slowly dissolving linear alkyl sulfate salts in which the alkyl group has an average of from about 16 to about 22 carbon atoms, and linear alkyl carboxylate salts in which the alkyl group has an average of from about 16 to about 24 carbon atoms.

The alkyl groups for both types of surfactant are preferably derived from natural fats such as tallow. Shorter chain alkyl sulfates or carboxylates, in which the alkyl group is derived from sources comprising a mixture of alkyl moieties more than 40% of which contain 14 or less carbon atoms, are less suitable as they cause the first component to form a gel like mass during dissolution.

The level of anionic surfactant in the spray dried powder forming the first component is from about 0.75% to about 40% by weight, more usually from about 2.5% to about 25% preferably from about 3% to about 20% and most preferably from about 5% to about 15% by weight. Water-soluble surfactants such as linear alkyl benzene sulfonates or $C_{14}$–$C_{15}$ alkyl sulfates can be included or alternatively may be applied subsequently to the spray dried powder by spray on.

The other major ingredient of the spray dried powder is one or more inorganic or organic salts that provide the crystalline structure for the granules. The inorganic and/or organic salts may be water-soluble or water-insoluble, the latter type being comprised by the, or the major part of the, water-insoluble builders where these form part of the builder ingredient. Suitable water soluble inorganic salts include the alkali metal carbonates and bicarbonates. Alkali metal silicates other than crystalline layered silicates can also be present in the spray dried granule provided that aluminosilicate does not form part of the spray dried component.

However, for the purposes of the present invention it is preferred that water-soluble sulfate, particularly sodium sulfate, should not be present at a level of more than 2.5% by weight of the composition. Preferably no sodium sulfate is added as a separate ingredient and its incorporation as a by-product e.g. with sulf(on)ated surfactants, should be minimised.

It is believed that the presence of sodium sulfate, which can exist in several hydrated forms over the temperature range 15°–25° C. permits migration of water and destabilising metal ions within the product. This in turn increases the tendency of the percarbonate bleach to decompose under conditions of fluctuating temperature and humidity. Furthermore, sodium sulfate itself is a primary source of heavy metals such as iron, copper and manganese. Each of these metals exerts a catalytic influence on the decomposition of sodium percarbonate and minimisation of the sodium sulfate level therefore assists in reducing the level of these destabilising metals.

Where an aluminosilicate zeolite forms the, or part of the, builder ingredient, it is preferred that it is not added directly by dry-mixing to the other components, but is incorporated into the multi-ingredient component(s). Where incorporation of the zeolite takes place in the spray-dried granule, any silicate present should not form part of the spray-dried granule. In these circumstances incorporation of the silicate can be achieved in several ways, e.g. by producing a separate silicate-containing spray-dried particulate, by incorporating the silicate into an agglomerate of other ingredients, or more preferably by adding the silicate as a dry mixed solid ingredient.

The first component can also include up to 15% by weight of miscellaneous ingredients such as brighteners, anti-redeposition agents, photoactivated bleaches and heavy metal sequestering agents. Where the first component is a spray dried powder it will normally be dried to a moisture content of from about 7% to about 11% by weight, more preferably from about 8% to about 10% by weight of the spray dried powder. Moisture contents of powders produced by other processes such as agglomeration may be lower and can be in the range 1–10% by weight.

It has been found that the stability of the percarbonate in the product is a function of the Equilibrium Relative Humidity of the product, which itself reflects the level of active moisture in the product. Spray-dried powder is a prime source of active moisture and also contributes significantly to the heavy metal ion content of a product. Thus although it represents a convenient and valuable processing route for certain ingredients, particularly surfactants and organic polymers, by providing acceptable particle solution and flow characteristics, its benefit has to be balanced against the adverse effects it exerts on percarbonate stability For these reasons the amount of any spray-dried component should preferably not exceed 35% by weight of the composition and most preferably should not exceed 30% by weight.

The particle size of the first component is conventional and preferably not more than about 5% by weight should be above 1.4 mm, while not more than about 10% by weight should be less than 0.15 mm in maximum dimension. Preferably at least about 60%, and most preferably at least about 80%, by weight of the powder lies between 0.7 mm and 0.25 mm in size. For spray dried powders, the bulk density of the particles from the spray drying tower is conventionally in the range from about 540 to about 600 g/liter and this is then enhanced by further processing steps such as size reduction in a high speed cutter/mixer followed by compaction. Alternatively, processes other than spray drying may be used to form a high density particulate directly.

A second component of a preferred composition in accordance with the invention is another multi-ingredient particulate containing a water soluble surfactant.

This may be anionic, nonionic, cationic or semipolar in type or a mixture of any of these. Suitable surfactants are listed hereinbefore but preferred surfactants are $C_{14}$–$C_{15}$ alkyl sulfates, linear $C_{11}$–$C_{15}$ alkyl benzene sulfonates and fatty $C_{14}$–$C_{18}$ methyl ester sulfonates.

The second component may have any suitable physical form i.e. it may take the form of flakes, prills, marumes, noodles, ribbons, or granules which may be spray-dried or non spray-dried agglomerates. Although the second component could in theory comprise the water soluble surfactant on its own, in practice at least one organic or inorganic salt is included to facilitate processing. This provides a degree of crystallinity, and hence acceptable flow characteristics, to the particulate and may be any one or more of the organic or inorganic salts present in the first component.

The particle size range of the second component is not critical but should be such as to obviate segregation from the particles of the first component when blended therewith.

Thus not more than about 5% by weight should be above 1.4 mm while not more than about 10% should be less than 0.15 mm in maximum dimension.

The bulk density of the second component will be a function of its mode of preparation. However, the preferred form of the second component is a mechanically mixed agglomerate which may be made by adding the ingredients dry or with an agglomerating agent to a pan agglomerator, Z blade mixer or more preferably an in-line mixer such as those manufactured by Schugi (Holland) BV, 29 Chroomstraat 8211 AS, Lelystad, Netherlands and Gebruder Lodige Maschinenban GmbH, D-4790 Paderborn 1, Elsenerstrasse 7–9, Postfach 2050 F.R.G. By this means the second component can be given a bulk density in the range from about 650 g/liter to about 1190 g/liter more preferably from about 750 g/liter to about 850 g/liter.

Preferred compositions include a level of alkali metal carbonate in the second component corresponding to an amount of from about 3% to about 15% by weight of the composition, more preferably from about 5% to about 12% by weight. This will provide a level of carbonate in the second component of from about 20% to about 40% by weight.

A highly preferred ingredient of the second component is also a hydrated water insoluble aluminosilicate ion exchange material of the synthetic zeolite type, described hereinbefore, present at from about 10% to about 35% by weight of the second component. The amount of water insoluble aluminosilicate material incorporated in this way is from about 1% to about 10% by weight of the composition, more preferably from about 2% to about 8% by weight.

In one process for preparing the second component, the surfactant salt is formed in situ in an inline mixer. The liquid acid form of the surfactant is added to a mixture of particulate anhydrous sodium carbonate and hydrated sodium aluminosilicate in a continuous high speed blender such as a Lodige KM mixer and neutralised to form the surfactant salt whilst maintaining the particulate nature of the mixture. The resultant agglomerated mixture forms the second component which is then added to other components of the product. In a variant of this process, the surfactant salt is pre-neutralised and added as a viscous paste to the mixture of the other ingredients. In this variant, the mixer serves merely to agglomerate the ingredients to form the second component.

In a particularly preferred process for making compositions in accordance with the invention, part of the spray dried product comprising the first granular component is diverted and subjected to a low level of nonionic surfactant spray on before being reblended with the remainder. The second granular component is made using the preferred process described above. The first and second components together with other dry mix ingredients such as any carboxylate chelating agent, the sodium percarbonate bleach, bleach activator, soil-release polymer, silicate of conventional or crystalline layered type and enzyme are then fed to a conveyor belt, from which they are transferred to a horizontally rotating drum in which perfume and silicone suds suppressor are sprayed on to the product. In highly preferred compositions, a further drum mixing step is employed in which a low (approx. 2% by weight) level of finely divided crystalline material is introduced to increase density and improve granular flow characteristics. This material should not however be an aluminosilicate zeolite builder as it has been found that zeolite builders present in discrete particulate form in the product have an adverse effect on percarbonate stability.

Compositions in accordance with the invention can also benefit from delivery systems that provide transient localised high concentrations of product in the drum of an automatic washing machine at the start of the wash cycle, thereby also avoiding problems associated with loss of product in the pipework or sump of the machine.

Delivery to the drum can most easily be achieved by incorporation of the composition in a bag or container from which it is rapidly releasable at the start of the wash cycle in response to agitation, a rise in temperature or immersion in the wash water in the drum. Alternatively the washing machine itself may be adapted to permit direct addition of the compostion to the drum e.g. by a dispensing arrangement in the access door.

Products comprising a detergent composition enclosed in a bag or container are usually designed in such a way that container integrity is maintained in the dry state to prevent egress of the contents when dry, but are adapted for release of the container contents on exposure to a washing environment, normally on immersion in an aqueous solution.

Usually the container will be flexible, such as a bag or pouch. The bag may be of fibrous construction coated with a water impermeable protective material so as to retain the contents, such as is disclosed in European published Patent Application No. 0018678. Alternatively it may be formed of a water-insoluble synthetic polymeric material provided with an edge seal or closure designed to rupture in aqueous media as disclosed in European Published Patent Application Nos. 0011500, 0011501, 0011502, and 0011968. A convenient form of water frangible closure comprises a water soluble adhesive disposed along and sealing one edge of a pouch formed of a water impermeable polymeric film such as polyethylene or polypropylene.

In a variant of the bag or container product form, laminated sheet products can be employed in which a central flexible layer is impregnated and/or coated with a composition and then one or more outer layers are applied to produce a fabric-like aesthetic effect. The layers may be sealed together so as to remain attached during use or may separate on contact with water to facilitate the release of the coated or impregnated material.

An alternative laminate form comprises one layer embossed or deformed to provide a series of pouch-like containers into each of which the detergent components are deposited in measured amounts, with a second layer overlying the first layer and sealed thereto in those areas between the pouch-like containers where the two layers are in contact. The components may be deposited in particulate, paste or molten form and the laminate layers should prevent egress of the contents of the pouch-like containers prior to their addition to water. The layers may separate or may remain attached together on contact with water, the only requirement being that the structure should permit rapid release of the contents of the pouch-like containers into solution. The number of pouch-like containers per unit area of substrate is a matter of choice but will normally vary between 500 and 25,000 per square meter.

Suitable materials which can be used for the flexible laminate layers in this aspect of the invention include, among others, sponges, paper and woven and non-woven fabrics.

However the preferred means of carrying out the process of the invention is to introduce the composition into the liquid surrounding the fabrics that are in the drum via a reusable dispensing device having walls that are permeable to liquid but impermeable to the solid composition.

Devices of this kind are disclosed in European Patent Application Publication Nos. 0343069 & 0343070. The latter Application discloses a device comprising a flexible sheath in the form of a bag extending from a support ring defining an orifice, the orifice being adapted to admit to the bag sufficient product for one washing cycle in a washing cycle. A portion of the washing medium flows through the orifice into the bag, dissolves the product, and the solution then passes outwardly through the orifice into the washing medium. The support ring is provided with a masking arrangement to prevent egress of wetted, undissolved, product, this arrangement typically comprising radially extending walls extending from a central boss in a spoked wheel configuration, or a similar structure in which the walls have a helical form.

The invention is illustrated in the following non limiting Examples, in which all percentages are on a weight basis unless otherwise stated.

In the detergent compositions, the abbreviated component identifications have the following meanings:.

| | |
|---|---|
| $C_{12}$ LAS | Sodium linear $C_{12}$ alkyl benzene sulfonate |
| TAS | Sodium tallow alcohol sulfate |
| $C_{14/15}$ AS | Sodium $C_{14}$–$C_{15}$ alkyl sulfate |
| $TAE_n$ | Tallow alcohol ethoxylated with n moles of ethylene oxide per mole of alcohol |
| 45E7 | A $C_{14}$–$C_{15}$ predominantly linear primary alcohol condensed with an average of 7 moles of ethylene oxide |
| $CnAE_{E6.5}$ | A $C_{12}$–$C_{13}$ primary alcohol condensed with 6.5 moles of ethylene oxide. |
| PEG | Polyethylene glycol (MWt normally follows) |
| TAED | Tetraacetyl ethylene diamine |
| Silicate | Amorphous Sodium silicate ($SiO_2$:$Na_2O$ ratio normally follows) |
| NaSKS-6 | Crystalline layered silicate of formula $\delta Na_2Si_2O_5$ |
| Carbonate | Anhydrous sodium carbonate |
| CMC | Sodium carboxymethyl cellulose |
| Zeolite A | Hydrated Sodium Aluminosilicate of formula $Na_{12}(AlO_2SiO_2)_{12}.27H_2O$ having a primary particle size - the range from 1 to 10 micrometers |
| Polyacrylate | Homopolymer of acrylic acid of MWt 4000 |
| Citrate | Trisodium citrate dehydrate |
| Photoactivated Bleach | Tetra sulfonated Zinc phthalocyanine |
| MA/AA | Copolymer of 1:4 maleic/acrylic acid, average molecular weight about 80,000. |
| MVEMA | Maleic anhydride/vinyl methyl ether copolymer, believed to have an average molecular weight of 240,000. This material was prehydrolysed with NaOH before addition. |
| Perborate | Sodium perborate tetrahydrate of nominal formula $NaBO_2.3H_2O.H_2O_2$ |
| Perborate monohydrate | Anhydrous sodium perborate bleach empirical formula $NaBO_2.H_2O_2$ |
| Enzyme | Mixed proteolytic and amylolytic enzyme sold by Novo Industrie AS. |
| Brightener | Disodium 4,4'-bis(2-morpholino-4-anilino-s-triazin-6-ylamino) stilbene-2:2'-disulfonate. |
| DETPMP | Diethylene triamine penta (methylene phosphonic acid), marketed by Monsanto under the Trade name Dequest 2060 |
| Mixed Suds Suppressor | 25% paraffin wax Mpt 50° C., 17% hydrophobic silica, 58% paraffin oil. |

EXAMPLE I

The following Compositions were prepared. Products A and B are in accordance with the invention, while Product C is a comparative product.

| | A | B | C |
|---|---|---|---|
| $C_{12}$LAS | 6.80 | 6.80 | 5.90 |
| TAS | 2.20 | 2.20 | 2.50 |
| 45E7 | 3.27 | 3.27 | 5.36 |
| $TAE_{11}$ | 1.00 | 1.00 | 1.00 |
| Zeolite A | 22.90 | 22.90 | 20.50 |
| $SiO_2$:$Na_2O$ = 2.0:1 | 2.50 | 2.50 | 2.92 |
| Polyacrylate | — | — | 3.90 |
| Citrate | 8.00 | 8.00 | — |
| MA/AA | 4.25 | 4.25 | — |
| Carbonate | 14.00 | 14.00 | 12.67 |
| Percarbonate | 14.00 | 14.00* | 15.00 |
| DETPMP | 0.19 | 0.19 | 0.43 |
| Enzyme | 1.20 | 1.20 | 0.79 |
| CMC | 0.48 | 0.48 | 0.30 |
| Photoactivated Bleach | 20 ppm | 20 ppm | 15 ppm |
| Brightener | 0.24 | 0.24 | 0.12 |
| Suds Suppressor | 0.49 | 0.49 | 0.42 |
| Perfume | 0.43 | 0.43 | 0.30 |
| Miscellaneous | 3.70 | 3.70 | 2.70 |
| Moisture | 4 | 4 | 4.90 |
| Iron | 20.5 ppm | 20.5 ppm | 37.0 ppm |
| Manganese | 2 ppm | 2 ppm | 1.3 ppm |
| Copper | 2 ppm | 2 ppm | 2.4 ppm |
| Sulfate | 1.00 max | 1.00 max | 7.73 |
| Density g/liter | 700 | 700 | 700 |
| Equilibrium Relative Humidity RH (%) | 25 | 25 | 51 |

*Coated percarbonate adjusted to give identical level of available $O_2$ (1.88% of product) to Product A Products A and B were made by a combination of spray drying, agglomeration and dry mixing techniques. A spray dried powder was made incorporating all of the TAS, approximately one quarter of the LAS, all of the Maleic anhydride/acrylic acid copolymer, DETPMP, CMC and brightener and part of the carbonate and zeolite builders. Approximately 82% of the zeolite and 65% of the carbonate were included in the crutcher and the spray dried product was passed through a Lodige KM high speed mixer/cutter, following which the 45E7 nonionic was sprayed on to the granules. The treated granules were then transferred to a conveyor belt. The remainder of the LAS, carbonate and zeolite were processed in a Lodige KM high speed mixer to form agglomerated particles which were fed to the conveyor belt. The other dry solid ingredients viz. the citrate, silicate, percarbonate and bleach activator were also added to the belt at the same time. Finally the mixed particulates were subjected to a low intensity blending step in a mix drum, during which step the perfume and suds suppressor were sprayed on to the particulates to form the finished product.

Product C was made by the conventional method of spray drying the bulk of the ingredients and adding the heat sensitive ingredients by means of spray-on for liquids and dry mixing of the solids. Thus the LAS, TAS, zeolite, silicate, sulphate, CMC, DETPMP, brightener and polyacrylate were formed into a spray dried powder and the 45E7 was applied to the powder as a liquid spray-on. The granules were then transferred to a conveyor belt to which the other dry mixed ingredients viz. carbonate, percarbonate, TAED and enzyme were added as particulates and the mixture was passed through a slow speed mixing drum in which perfume and suds suppressor were applied as a spray.

The products were then placed on storage at 32° C. and 80% RH in closed wax laminated cardboard cartons and measurements were made of the available oxygen value for each at 0, 1, 2, 3 and 4 weeks. Four weeks storage under these conditions is believed to correlate with storage for at least 6 months under Southern European summer conditions.

The results were as follows, expressed as % of the original available oxygen level

| | 1 Week | 2 Weeks | 3 Weeks | 4 Weeks |
|---|---|---|---|---|
| A | 90 | 80 | 70 | 60 |
| B | 97 | 94 | 91 | 88 |
| C | 64 | 23 | 20 | 17 |

It can be seen that Products A and B in accordance with the invention display acceptable percarbonate stability under the stated storage conditions, whereas the comparison product C does not have an acceptable percarbonate stability.

We claim:

1. A solid laundry detergent composition, comprising by weight:

(a) from about 5% to about 20% of an organic surfactant;

(b) from about 25% to about 60% of one or more non-phosphate detergent builder salts;

(c) from about 3% to about 20% of a coated alkali metal percarbonate bleach wherein the coating comprises sodium silicate in an amount from about 2% to 5% by weight of the percarbonate;

wherein the composition:

i) has a bulk density of at least about 650 g/liter, ii) contains less than about 25 ppm total of Iron, Copper and Manganese ions; and iii) has an equilibrium relative humidity of not more than about 25% at 32° C., whereby the weight percentage of the original percarbonate remaining undecomposed after 28 days storage in closed wax laminate paperboard cartons at 32° C. and 80% Relative Humidity is at least 60%;

wherein the composition comprises, by weight of the composition:

1) from about 15% to 25% of a first multi-ingredient component comprising, by weight of the first component: (i) from about 0.75 to 40% anionic surfactant and (ii) from about 60 to 99.25% of organic or inorganic salts; and 2) from about 1 to 50% of a second multi-ingredient component comprising a water-soluble surfactant and at least one organic or inorganic salt;

wherein the level of hydratable water-soluble sulfates in the composition is no more than about 1.0% the level of hydratable water-soluble sulfate which is present being in the form of a separately added ingredient;

wherein the first multi-ingredient component comprises a spray-dried powder, and wherein the second multi-ingredient component comprises an agglomerate of non-spray-dried ingredients.

2. A composition according to claim 1 wherein the weight percentage of the original percarbonate remaining undecomposed after 28 days storage in closed wax laminated paperboard cartons at 32° C. and 80% Relative Humidity is at least about 80%.

3. A composition according to claim 1 wherein each multi-ingredient component contains a proportion of both ingredients a) and b).

4. A composition according to claim 3 wherein the non-phosphate detergent builder ingredient is selected from the group consisting of alkali metal carbonates, bicarbonates, silicates, aluminosilicates, polycarboxylates, amino poly (alkylene phosphonates) and mixtures thereof.

5. A composition according to claim 4 wherein the non-phosphate detergent builder ingredient includes a sodium aluminosilicate zeolite of formula $Na_z\ [(AlO_2)_z\ (SiO_2)_y].\ xH_2O$ wherein z and y are at least 6, the ratio of z to y is from 1.0 to 0.5 and x is at least 5, said zeolite being present solely as part of a multi-ingredient component.

6. A composition according to claim 5, wherein said non-phosphate detergent builder comprises sodium silicate having a ratio of $SiO_2$ to $Na_2O$ of from 1.6 to 3.0, said sodium silicate being present in a form that is discrete relative to any sodium aluminosilicate present in the composition.

7. A composition according to claim 6 wherein the non-phosphate detergent builder ingredient comprises a mixture of hydrated sodium zeolite A, sodium silicate, tri-sodium citrate dihydrate and sodium carbonate.

8. A composition according to claim 7 wherein the sodium silicate is a solid at ambient temperatures and is present as a discrete particulate.

9. A composition according to claim 8 wherein the sodium silicate is a crystalline layered silicate of formula $NaMSi_xO_{2x+1}.\ yH_2O$ wherein M is sodium or hydrogen, x is a number from 1.9 to 4 and y is a number from 0 to 20.

10. A composition according to claim 9 wherein M is Na, x is z and y is 0.

* * * * *